United States Patent [19]

Dilo

[11] 4,454,637

[45] Jun. 19, 1984

[54] METHOD FOR PRODUCING VELOUR NEEDLEFELT WEBS

[75] Inventor: Richard Dilo, Eberbach, Fed. Rep. of Germany

[73] Assignee: Oskar Dilo Maschinenfabrik KG., Fed. Rep. of Germany

[21] Appl. No.: 370,459

[22] Filed: Apr. 21, 1982

Related U.S. Application Data

[62] Division of Ser. No. 108,041, Dec. 28, 1979, Pat. No. 4,378,618.

[30] Foreign Application Priority Data

Jan. 11, 1979 [DE] Fed. Rep. of Germany ..... 2900935

[51] Int. Cl.[3] ..... D04H 11/08

[52] U.S. Cl. ..... 28/110

[58] Field of Search ..... 28/110, 111, 115; 156/148

[56] References Cited

U.S. PATENT DOCUMENTS

| | | | |
|---|---|---|---|
| 3,530,557 | 9/1970 | Dilo | 28/110 |
| 3,758,926 | 9/1973 | Dilo | 28/110 |
| 4,035,881 | 7/1977 | Zocher | 28/111 |
| 4,085,486 | 4/1978 | Dilo | 28/110 |
| 4,138,772 | 2/1979 | Dilo | 28/110 |

FOREIGN PATENT DOCUMENTS

| | | | |
|---|---|---|---|
| 2265895 | 10/1975 | France | 28/115 |

*Primary Examiner*—Robert Mackey

*Attorney, Agent, or Firm*—McGlew and Tuttle

[57] ABSTRACT

The invention refers to a method for the production of velour needlefelt webs by processing a fiber fleece bonded through needling, using velour or fork needles forming pile loops. At least one fiber fleece band which consists of several layers is helically wound to form a tube which continuously develops in an axial direction. The tube rotates about its own axis, wherein the individual layers of the fleece band partly overlap on each wind and the lower or inner-lying layers of the wound tube are bonded in a width which is smaller, preferably up to half the width of the width of the fleece band in a known manner using felting needles and from the upper or outer-lying loose fiber layer of the wound tube, the fibers forming the pile loops are pushed through the pre-bonded lower or inner-lying fiber layer in a known manner using fork needles. The finished processed tube is cut open in the axial direction, said flat and the so-formed material web is wound up.

6 Claims, 4 Drawing Figures

METHOD FOR PRODUCING VELOUR NEEDLEFELT WEBSsp

This is a divisional of a previous application Ser. No. 06/108,041 filed Dec. 28, 1979, now U.S. Pat. No. 4,378,618 granted Apr. 5, 1983.

FIELD AND BACKGROUND OF THE INVENTION

The invention refers to a method for the production of velour needlefelt webs of material by processing, i.e. needle punching a fiber fleece with felting needles for the purpose of bonding the fleece and subsequently needle punching the pe-bonded fiber fleece using fork needles for forming pile loops.

It is already known to produce velour needlefelt webs using needling techniques. Up to now this was done by building up or cross-laying a lengthwise orientated fiber fleece web delivered from a carding machine, in a zig-zag manner using a cross layer to form a multiply voluminous, transverse-orientated fiber fleece which is then subjected to further processing. The mentioned type of production of the fleece to be further processed causes an irregular build-up of the fleece, in particular an undesired increase in the thickness of the fleece in the edge region.

It is furthermore a disadvantage that when needling such a fleece, the thickness of the edge is further increased through the shrivelling (drawing together) of the material web, and this makes it necessary to cut the web causing a considerable amount of waste. The further processing of such a fleece is carried out in that the fiber fleece is needled for the purpose of bonding and subsequently the pile is formed using fork needles which push the pile loops out of the already relatively evenly bonded fiber fleece.

This mode of operation has several significant disadvantages concerning production as well as regarding the quality of the end product.

Since the fibers forming the pile loops have to be pushed out of the fiber fleece which has necessarily been bonded in its entire thickness, and as this fiber fleece has already undergone considerable compression, quite a considerable amount of work has to be performed in order to form the pile. This necessitates a high driving power of the machine as well as an extremely rigid machine design which is able to absorb the strong forces. As the end product is mainly for use as floor covering, the web must have a certain minimum width. The machine frame design must correspond to this width, so an enormous construction expense is inevitable with the common web widths, due to the required rigidity of the machine parts involved.

It is also a disadvantage that the machine output is limited as a result of heating-up of the tools and machine parts which occurs due to the high rubbing effect during the needling of the fiber web, especially during the pile formation. This heating often has detrimental effects on the fiber material as well as on the machine itself.

Finally, regarding the end product, it is disadvantageous that according to the already known method only 25–30% of the fiber material can be pushed out of the pre-bonded fiber fleece to form the pile, and this results in a very poorly formed fabric due to too low a pile density, and this enables only a very limited use.

A machine or unit for producing such velour needlefelt webs consists of the carding unit, the transverse or cross layer, a preneedling machine and a main needling machine, a velour needling machine and the necessary devices for the subsequent treatment of the mechanically processed web. This list clearly shows the hitherto considerable expenditure of apparatus, wherein it must be considered that the individual machines or devices must be of a width corresponding to that of the material web.

SUMMARY OF THE INVENTION

The invention is based on the task of suggesting a method which enables the production of a high quality velour needlefelt material which is in no way inferior to the velour material produced with other methods and, as opposed to the hitherto known velour needlefelt material, has a considerably more favorable fiber distribution regarding the pile and bottom material, and which can be carried out with a considerably lower expenditure of cost for the apparatus. Preferably, in the most favorable case, it should be possible that up to 70% of the fibers of the fiber web lie in the pile material and only 30% in the bottom material. Such a web is similar to all other velour material webs and is able to compete with them regarding the quality of the product.

For solving the given task, it is suggested according to the invention, for the production of velour needlefelt webs, that at first at least one fiber fleece band consisting of several layers is helically wound to form a tube which continuously develops in the axial direction, said tube rotating about its own axis, wherein the individual layers of the fiber fleece band partly overlap on each wind, that then the lower or inner lying layer of the wound tube is bonded in a width smaller, preferably about half of the width of the fiber fleece band itself in a per se known manner with felting needles and that then, from the upper or outer lying loose fiber layer of the wound tube, the pile-forming fibers are pushed through the pre-bonded lower or inner-lying fiber layer also in a known manner, using fork needles.

In order to achieve as evenly-thick and homogeneous a tube-wound fiber fleece as possible, the individual layers of a fiber fleece band are staggered in relation to each other and superposed in the opposite direction to that of the direction of motion of the tube. Upon winding the tube of the so-formed fiber fleece band, the individual layers are laid up at an acute angle relative to the cylindrical supporting surface of the tube.

The lateral displacement of the layers when building up the fiber fleece band, must be of a size that the inclined edge of the fleece band lies basically parallel to the supporting surface for the tube upon the formation thereof, or rather the edge attaches on to the slanted edge of the previous wind.

The tube, having been formed and processed in the described manner, and the outside of which is treated and processed in the usual manner or which can have a coating material applied to it, is then cut open in dependence of its rotation so that a web is formed with parallel edges which is then laid flat and rolled up.

The suggested method according to the invention has the substantial advantage that the fiber material wound to form a tube is only bonded to a certain height for the purpose of forming the bottom and that the loose fiber material situated above this pre-bonded and sufficiently dense fiber layer, is mainly pressed through the pre-bonded layer for the formation of the pile. The area in which the fleece, wound to form a tube, is processed, can be relatively small, since due to the winding of the tube with simultaneous axial movement, a sufficient processing of the fiber material takes place, and this requires a relatively low expenditure of apparatus cost and a considerably simpler machine design.

The machine for carrying out the method according to the invention has a shaft which is fixed to a frame, said shaft having a lamella strip helically wound thereon and secured thereto with an even, constant pitch. Opposite the strip, there is arranged at least one needle beam equipped with felting and fork needles which can move radially towards the shaft. A fiber fleece band feeding device and at least one tube turning and feeding device consisting of an endless conveyor belt are associated with the shaft formed in the aforementioned manner, in the area of the working area of the needles of the needle beam. The endless belt of the tube rotating and feeding device is passed over at least two deflecting rolls, wherein half of said belt lies under tension force against the outside of the tube so that when the belt is moved, the tube follows the motion due to the prevailing friction between said tube and belt and the tube is thus rotated.

Advantageously, there are two needle beams associated with the shaft having the lamella plate, so that two fiber fleece bands can also be fed in for the forming of the tube, and this increases the efficiency of the machine.

BRIEF DESCRIPTION OF THE DRAWINGS

Further features and details of the machine formed according to the invention can be seen from the following description of a preferred embodiment which is shown in FIGS. 1 to 4.

DESCRIPTION OF THE PREFERRED EMBODIMENT

Figure 1:
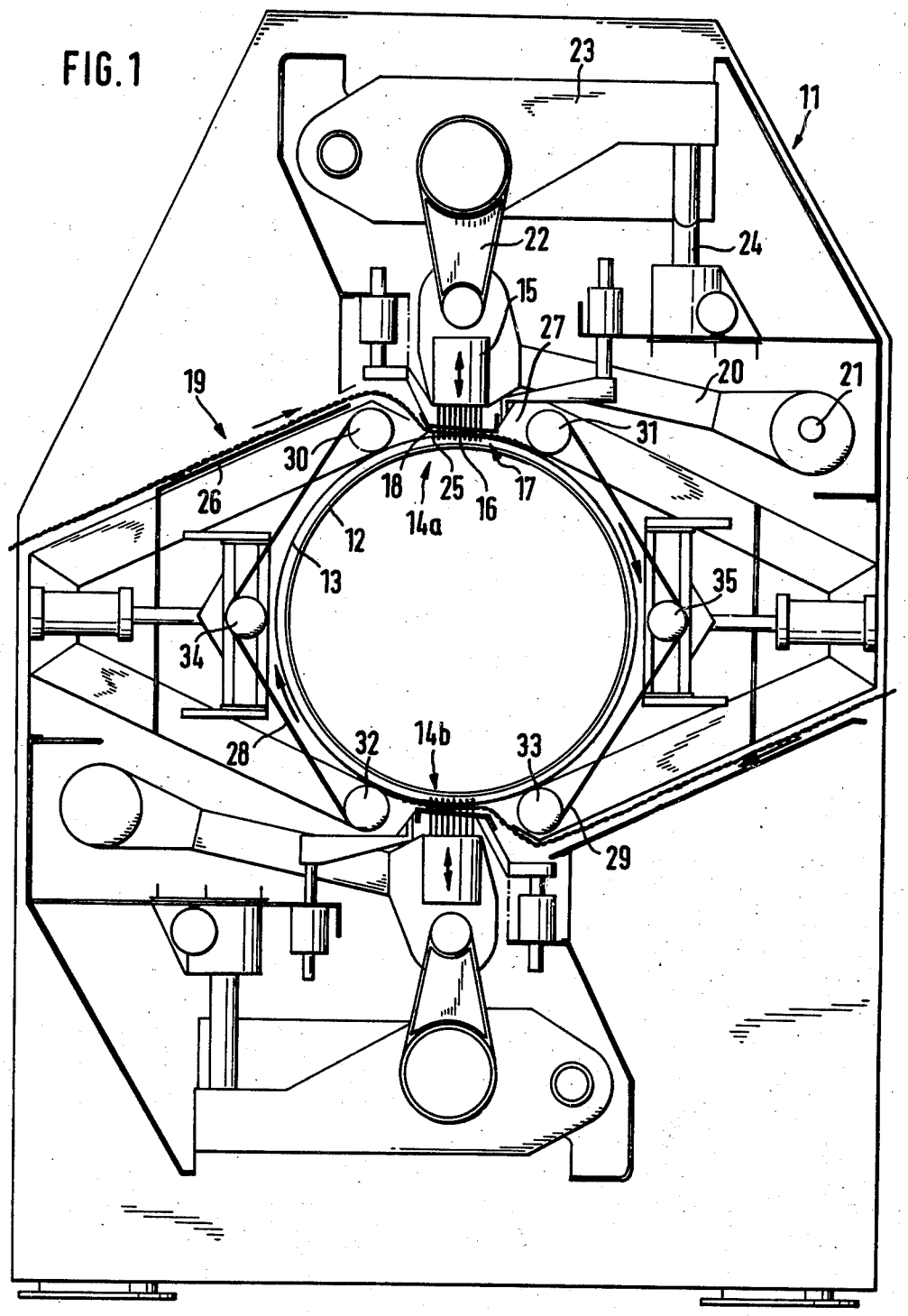
FIG. 1 shows a cross section of the machine, seen schematically.
Figure 3:
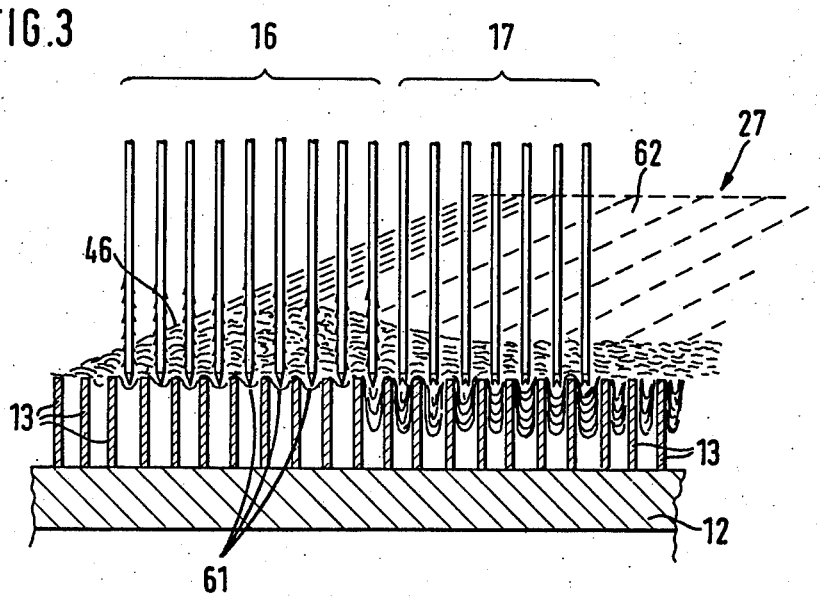
FIG. 3 shows a cross section through a part of the fiber material of several inclined superposed layers from which the fiber material tube is formed.

FIG. 1 shows a tube-shaped shaft 12 which, in this case, is horizontally fixed to a frame of the machine 11, not shown in detail. On the outer circumference of the shaft 12, a lamella plate 13 consisting of a steel fillet, is helically wound and adhered, with a pitch corresponding to the spacing of the needles in the needle beam (FIG. 3). Above and below the shaft 12 are situated the upper and lower needle stations 14*a* and 14*b* respectively, which are basically the same in structure and therefore only the upper needle station 14*a* will be described in detail. The needle beam 15, extending over a certain length of the shaft 12, carries two groups of needles arranged in tandem in the longitudinal direction of the shaft 12, these being the felting needles 16 and behind these the velour or fork needles 17. The needles 16 and 17 are passed through openings in the hold-down plate 18, the fiber fleece band being fed in between this hold-down plate 18 and the lamella plate made of lamellae 13. The needle beam is supported by one or more swords 20 which are mounted on an axle 21. The connecting rod 22, the sword lever 23 and the oscillated push or draw-bar 24 are responsible for setting the needle beam into upward and downward motion, wherein the free ends of the needles penetrate through the layered fleece 25 situated above the lamellae 13 of the shaft 12 in a known manner, to bond the area of the fleece 25 adjacent the lamellae 13 on the one hand and to push the fibers from the outer lying loose layer of the fleece through the bonded base layer to form the pile loops.

The fiber fleece band belt 19 is fed in to the needle stations 14*a*, 14*b* via the guide plate 26. The feed speed of the fiber fleece belt 19 is synchronous to the rotating speed of the fiber material tube 27 formed about the shaft 12 with its lamellae 13, said tube being constantly, evenly turned with the aid of a tube-turning device. This device consists of the two endless belts 28,29 which are deflected via two upper rolls 30, 31 and two lower rolls 32, 33 respectively, and brought under tension via middle rolls 34 and 35, respectively. Belts 28,29 lie against the fiber material tube 27 under corresponding initial tension and press the tube against the lamella plate 13 and due to the friction, drive the tube 27 in correspondence with the movement of the belts 28,29. Since the lamellae are made up from a spiral-wound fillet and in the second part of the needle station 14*a* (at needles 17), the pile loops are pushed between two adjacent lamellae respectively (FIG. 3), the fiber material tube 27 is automatically moved axially with rotation of the shaft 12 and in correspondence with the pitch of the lamella plate 13.

Figure 2:
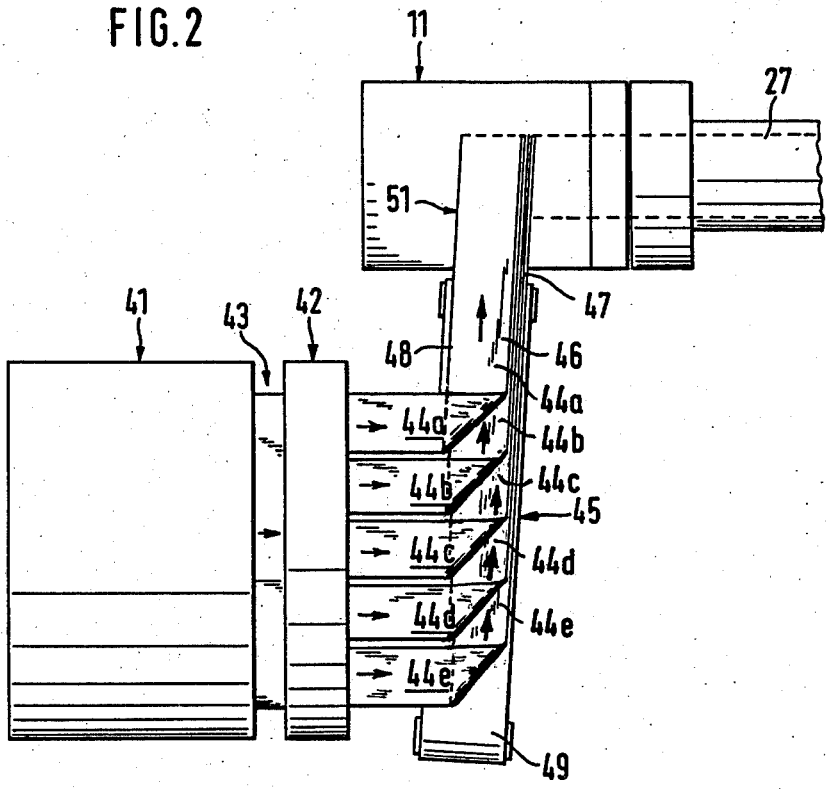
FIG. 2 shows a top view of the schematically shown machine.

As FIG. 2 shows, a carding machine 41 with web divider 42 is associated with the previously described machine 11, said web divider 42 dividing the web 43 coming from the carding machine into strips 44*a* to 44*e* moving to the right in FIG. 2. The web strip layering device 45 diverts the web strips 44*a* to 44*e* upwardly in FIG. 2, in the shown manner and lays or stacks on each other in such a way that each web strip, which lays over a lower web strip, is in a staggered arrangement to said lower strip so that the so formed fiber fleece band 46 consists of five layers staggered in relation to each other, said layers having a reduced longitudinal edge area 47 or 48 respectively as can be seen from FIG. 3. Band 46 thus forms the fiber fleece band belt 19 which moves over shaft 12 in a helical fashion.

The web strips 44*a* to 44*e* or rather the formed fleece band 46 is laid up on the conveyor belt 49 which leads it to the fleece band feed and guide device at 51 (not shown in detail) which ensures that the fiber fleece 46 is laid up in layers, in a proper manner for the formation of the fiber material tube 27. That is, the individual layers of the fiber fleece band 46 lie inclined at an acute angle and that an evenly high fiber material layer is maintained with even, homogeneous fiber distribution, as can be seen from FIG. 3 which schematically shows the layer formation of the fiber material tube 27. Through this type of structure of the fiber material which is to be needled, and through the arrangement of the needle zones in the area of the infeed of the fiber fleece band 46 in the machine 11, it is achieved that the needles of the needle group 16, serving the pre-bonding of the bottom layer 61 only grasp the lower or rather inner layer 61 and not the fibers lying in the top or outer loose layer 62 which, on entry of the fleece band 46 and during development of the tube 27 are caught by the velour or fork needles of the needle group 17 and pushed through the lower or inner layer 61 into the spaces between the individual lamellae 13 to form the pile loops.

The representation shown in FIG. 3 is only schematic in the area of the needles since behind the needles, the fiber material of the tube 27 actually takes on a different form, i.e. the surface sinks and the material width becomes less, as on the one hand it has been bonded and on the other hand the fibers have been pushed through the bonded layer as pile loops. FIG. 3 is mainly to show the theoretical structure of the fiber material from which the fiber material tube 27 is formed.

Figure 4:
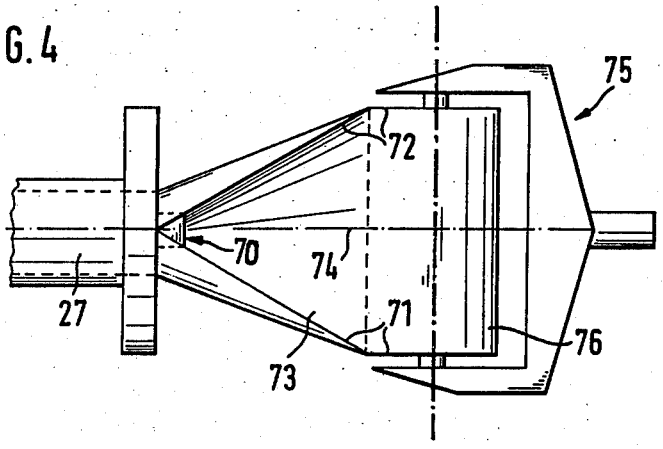
FIG. 4 shows a top view of the cutting and winding appliance downstream of the machine.

The tube 27 formed in the aforementioned manner is, as shown in FIG. 4, either immediately cut after the formation thereof with a cutting device 70, or possibly after subsequent treatment of its outside, e.g. through application of a coating in a known manner, said cutting device 70 being rotatably mounted and synchronously turned with the tube, in order to achieve parallel edges 72, 71, of the flat velour needlefelt web 73. The web 73 is then rolled up to a bale 76 with the aid of the winding device 75. The device 75 is rotatable about the tube axis 74.

I claim:

1. A method of producing a velour needlefelt web comprising:

superimposing a plurality of fiberfelt strips in staggered fashion so that at least a longitudinal edge area of each strip remains exposed from an overlying strip, to form a fiber fleece band having a transverse width;

helically winding said band about an axis to form a tube which develops along the axis, with said band at least partly overlapping itself in an overlapping area with each helical winding, said tube rotating about the axis;

binding at least inner fiber fleece strips of said tube by a selected width in said overlapping area using a plurality of felting needles extending along the axis;

forming pile loops in said tube after said binding using fork needles moving from an outer to an inner fiber fleece strip of said tube; and axially cutting said tube to form a material web.

2. A method according to claim 1, wherein said selected width of binding is at most one half said transverse width of said fiber fleece band.

3. A method according to claim 2, including flattening said material web cut from said tube and winding said flattened material web.

4. A method according to claim 2, wherein said plurality of fiber fleece strips are staggered in a direction opposite to said developing direction of said tube.

5. A method according to claim 2, including providing a cylindrical supporting surface for receiving said band for helical winding, said band being helically wound at an acute angle to said axis, and said strips being staggered so that, said tube is made up at all locations of a stack of fiber fleece strips of equal thickness and equal number of fiber fleece strips.

6. A method according to claim 5, wherein said cylindrical support includes a helically wound plate forming a plurality of lamellae spaced by an amount equal to a spacing of said felting and forked needles, for receiving said felting and forked needles therebetween and for receiving said tube thereon.

* * * * *